US007337904B2

(12) United States Patent
Hengami

(10) Patent No.: US 7,337,904 B2
(45) Date of Patent: Mar. 4, 2008

(54) HEART SHAPED PACKAGE

(76) Inventor: David T. Hengami, 4465 Torrance Blvd., Torrance, CA (US) 90505

( * ) Notice: Subject to any disclaimer, the term of this patent is extended or adjusted under 35 U.S.C. 154(b) by 91 days.

(21) Appl. No.: 11/411,326

(22) Filed: Apr. 26, 2006

(65) Prior Publication Data

US 2007/0251848 A1 Nov. 1, 2007

(51) Int. Cl.
*B65D 25/00* (2006.01)

(52) U.S. Cl. ..... 206/457; 229/116.2; 229/122; 229/125.12; 229/131.1

(58) Field of Classification Search ..... 206/457, 206/583; 229/122, 129.1, 131.1, 125.12, 229/116.2, 116.5
See application file for complete search history.

(56) References Cited

U.S. PATENT DOCUMENTS

| | | | | |
|---|---|---|---|---|
| 2,000,210 | A | 5/1935 | Bayless | |
| 2,330,926 | A | 10/1943 | Rous | |
| 2,379,038 | A | 6/1945 | Rous | |
| 2,431,786 | A | 12/1947 | Williamson | |
| 2,903,175 | A | 9/1959 | Peimer | |
| 2,983,421 | A | 5/1961 | Turpin | |
| 3,016,178 | A * | 1/1962 | Knocks | 229/116.2 |
| 3,021,982 | A | 2/1962 | Robinson, Jr. | |
| 3,033,436 | A | 5/1962 | Peimer | |
| 3,040,953 | A | 6/1962 | Tindell | |
| 3,610,510 | A * | 10/1971 | Lowry | 229/116.2 |
| 3,780,934 | A | 12/1973 | Gardner | |
| 3,819,093 | A | 6/1974 | Forbes, Jr. | |
| 4,066,207 | A | 1/1978 | Jorgensen-Beck et al. | |
| 4,081,128 | A | 3/1978 | O'Neil | |
| 4,197,985 | A | 4/1980 | Austin | |
| 5,184,770 | A | 2/1993 | Cote | |
| 5,213,255 | A | 5/1993 | Cote | |
| 5,505,373 | A | 4/1996 | von Stillfried | |
| D375,456 | S | 11/1996 | Borgmann | |
| 5,845,424 | A * | 12/1998 | Mitchell | 40/661.06 |
| D418,412 | S | 1/2000 | Komatsu | |
| 6,116,499 | A | 9/2000 | Todjar-Hengami | |
| 6,273,332 | B1 | 8/2001 | Todjar-Hengami | |
| 6,360,941 | B1 | 3/2002 | Larsson | |
| 6,422,388 | B1 | 7/2002 | McCahey | |
| 6,435,402 | B1 * | 8/2002 | Hengami | 229/120.03 |
| D471,451 | S | 3/2003 | Hadeler | |
| D506,133 | S | 6/2005 | Goodfellow et al. | |
| 6,945,449 | B2 | 9/2005 | Hengami | |
| 2003/0168501 | A1 | 9/2003 | Hengami | |
| 2003/0230498 | A1 * | 12/2003 | Maute | 206/38 |
| 2004/0065723 | A1 | 4/2004 | Hengami | |
| 2004/0159698 | A1 | 8/2004 | Tallevi et al. | |
| 2005/0067476 | A1 | 3/2005 | Hengami | |

* cited by examiner

*Primary Examiner*—Jacob K. Ackun, Jr.
(74) *Attorney, Agent, or Firm*—Lauson & Schewe LLP; Robert J. Lauson; Edward C. Schewe

(57) ABSTRACT

A package for dispensing pourable solid product includes a box having a pair of heart-shaped sides and a moveable slide for selectively opening and closing the product dispensing opening in the bottom portion of the box. Preferably the moveable slide is hingedly connected to an actuation panel extending down a side of the box. The package further preferably includes a wrapping applied to the box with a tear-away portion covering only the opening and slide, such that the tear away portion can be removed and the remainder of the wrapping stays in place decorating the box. Preferably and to great cost advantage, the box is formed from a single blank sheet of paper cardboard stock.

15 Claims, 11 Drawing Sheets

HEART SHAPED PACKAGE

BACKGROUND OF THE INVENTION

1. Field of the Invention

The present invention relates specialty packaging, and more particularly to a heart-shaped box for solid pourable product with a convenient slide opening/closure and formed from a single sheet of blank, and further optionally having decorative wrapping that may be maintained on the package even after it is opened.

2. Description of the Related Art

The slogan "presentation is everything" is especially applicable to gift giving. The right packaging can be even more important than the gift itself. Clever packaging is proven to increase sales. Applicant is the named inventor on numerous U.S. patents directed to specialty packaging including U.S. Pat. Nos. 6,116,499, 6,273,332, 6,360,942, 6,435,402 and 6,945,449 and other pending and international patents, and in addition is the owner of the von Stillfried U.S. Pat. No. 5,505,373 licensed for the popular Certs® mints box.

Around Valentine's Day and for other occasions the giving of candies and other pourable solid treats is traditional, often packaged in a heart-shaped box and decorated with heart symbols or gift wrapped in red-colored paper or plastic. Such boxes can be expensive to manufacture and not all that practical or functional, however, and sometimes not particularly attractive once the wrapping is removed to gain access to the contents. For example, one common type of prior art heart-shaped package includes a sliding tray with a separate cover or sleeve such that a large portion of the contents are typically exposed to gain access to a single piece of candy and the two-piece box is not "mass production friendly."

OBJECTS OF THE INVENTION

Accordingly, it is an object of the present invention to provide an improved heart-shaped package that is inexpensive and easy to manufacture on a mass scale;

It is a further object of the present invention to provide a heart-shaped box that is manufactured from a single sheet of blank stock;

It is a further object of the present invention to provide a heart-shaped package that offers additional features not previously known in such a package;

It is a further object of the present invention to provide a heart-shaped package that includes a slider opening, which optionally interacts with the artwork or other design features of the package;

It is a further object of the present invention to provide a heart-shaped package with a decorative wrapping that can remain on the box even after opening;

These and other objects and advantages of the present invention will become apparent upon reading the following detailed description and upon reference to the accompanying drawings.

SUMMARY OF THE INVENTION

A package for dispensing pourable solid product includes a box having a pair of substantially heart-shaped sides and a top and bottom portion, a product dispensing opening in the bottom portion of the box, and a moveable slide for selectively opening and closing the product dispensing opening. Preferably the moveable slide is hingedly connected to an actuation panel extending down a side of the box, visible to the user and providing easy pouring. The package further preferably includes a wrapping applied to the box with a tear-away portion covering the product dispensing opening and slide. Preferably the package is such that portions of the heart-shaped sides are squeezed together by the wrapping applied to the box. Despite the package having the outward appearance of being heart shaped, the box is composed of generally three or four straight sides and is thus generally triangular or diamond-shaped.

Preferably and to great advantage in minimizing mass production costs, the box is formed from a single blank, including a main box portion having two major sides of a generally heart-shaped configuration and a minor side between of a generally rectangular configuration and having an opening, and a top of a generally rectangular configuration foldably coupled to the main box portion. Further there is a second minor side of a generally rectangular configuration foldably coupled to one of the major sides and an actuation panel of a generally rectangular configuration foldably coupled to the other of the major sides; and a slide member foldably coupled to the actuation member. The slide member preferably includes a stop at the end. The top is preferably either foldably coupled to one of the major sides or split in two and foldably coupled to each of the minor sides. Optionally, operation of the slide opening may trigger other creative content of the package such as surprise or hidden visual and/or audio messages, e.g. "I love you" or the like.

Figure 1:
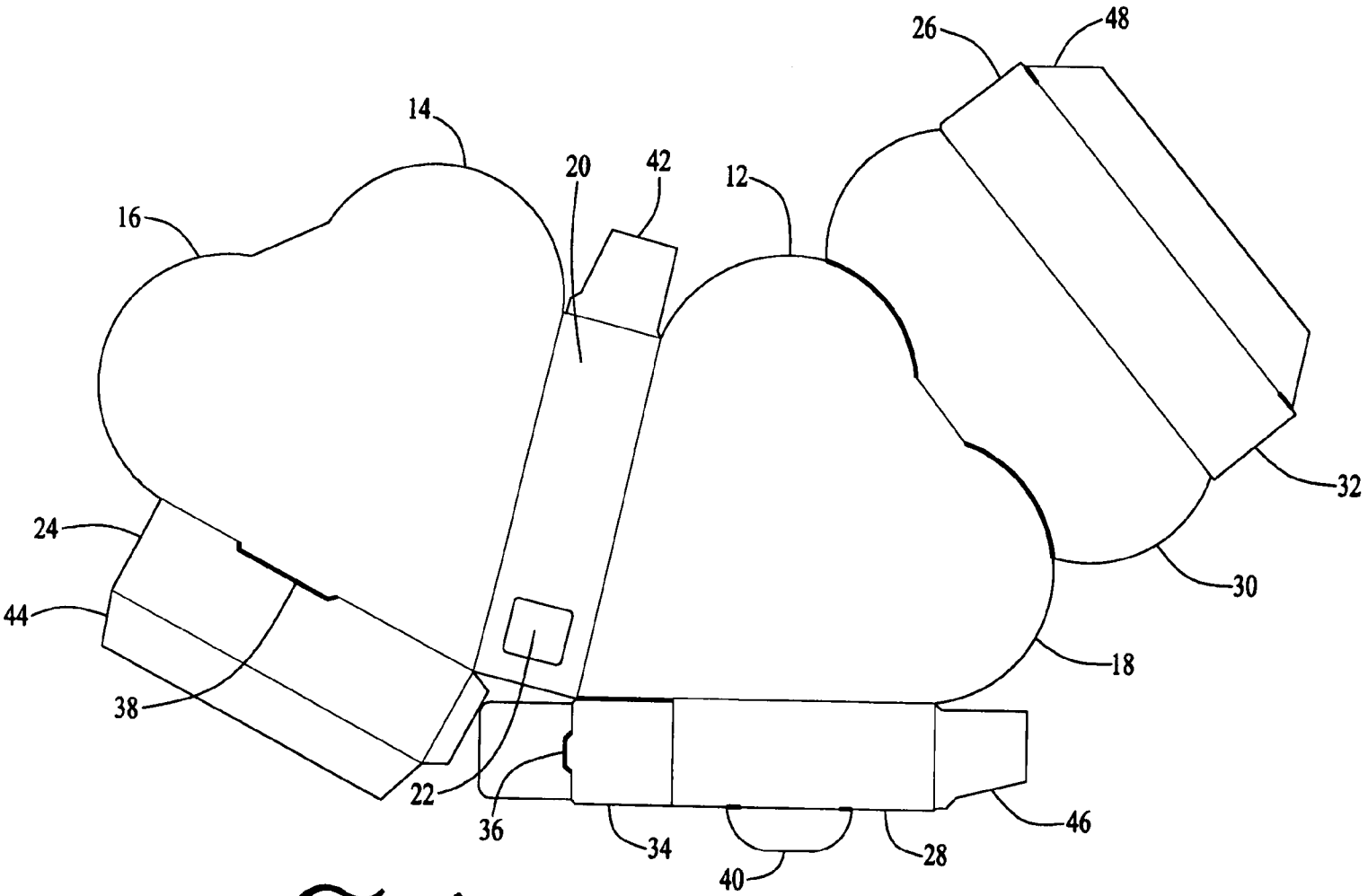
FIG. 1 is a flat pattern view of the blank stock from which the first preferred embodiment is made.

LISTING OF REFERENCE NUMERALS FOR FIRST-PREFERRED EMBODIMENT heart-shaped box 10
blank 12
main box portion 14
first major side 16
second major side 18
first minor side 20
opening 22
second minor side 24
top portion 26
actuation panel 28
extension member 30
top panel 32
slide member 34
small cut 36
larger cut 38
flaps 40, 42, 44, 46, 48
wrapping 50
tear-away portion 52.

LISTING OF REFERENCE NUMERALS FOR SECOND-PREFERRED EMBODIMENT heart-shaped box 110
blank 112
main box portion 114
first major side 116
second major side 118
first minor side 120
opening 122
second minor side 124
slide stop 126
actuation panel 128
first top panel 130
second top panel 132
slide member 134
small cut 136
larger cut 138
flaps 140, 142, 144, 146, 152, 154
first xxx 148
second xxx 150

DESCRIPTION OF THE PREFERRED EMBODIMENT(S)

Referring to FIGS. 1-9 a first preferred embodiment may be discussed. FIG. 1 shows a flat pattern for a heart-shaped package 10 to be made entirely from a single blank of paper cardboard stock 12. The blank 12 has a main box portion 14 consisting of a first major side 16 and a second major side 18 and a first minor side 20 between the two major sides 16, 18 and having an opening 22 that is shown square-shaped but may be most any shape. Further, there is a second minor side 24 attached to the first major side 16. The major sides 16, 18 are generally heart shaped while the minor sides 20, 24 are generally rectangular shaped.

Figure 5:
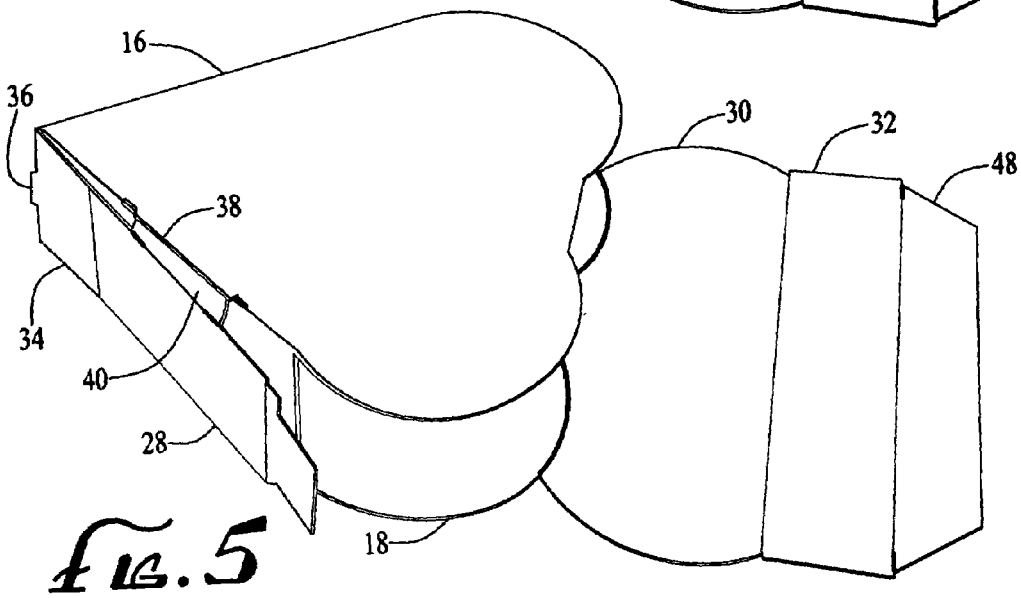
FIG. 5 is a perspective view of the fourth steps in folding the box.
Figure 9:
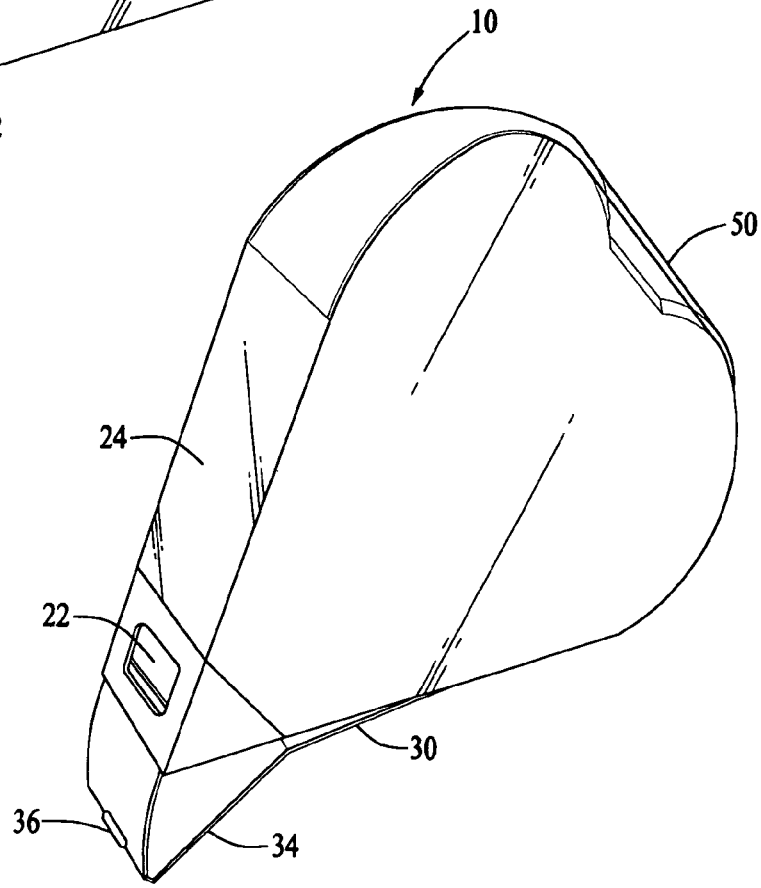
FIG. 9 is a perspective view of the wrapped package with a small portion of the wrapping removed and the slider opening.

Further attached to the second major side 20 are a top portion 26 and an actuation panel 28. The top portion 26 includes an extension member 30 to bring the rectangular-shaped top panel 32 down inside the assembled box (see FIG. 6). The actuation panel 28 includes a slide member 34 and a small cut 36 (which assemble and function as shown in FIG. 9). A larger cut 38 accepts the actuation panel 30 flap 40 (FIG. 5). The minor sides 20, 24 also have flaps 42, 44, respectively, as does the actuation panel 28 have a flap 46 and the top side 32 has flap 48.

Figure 2:
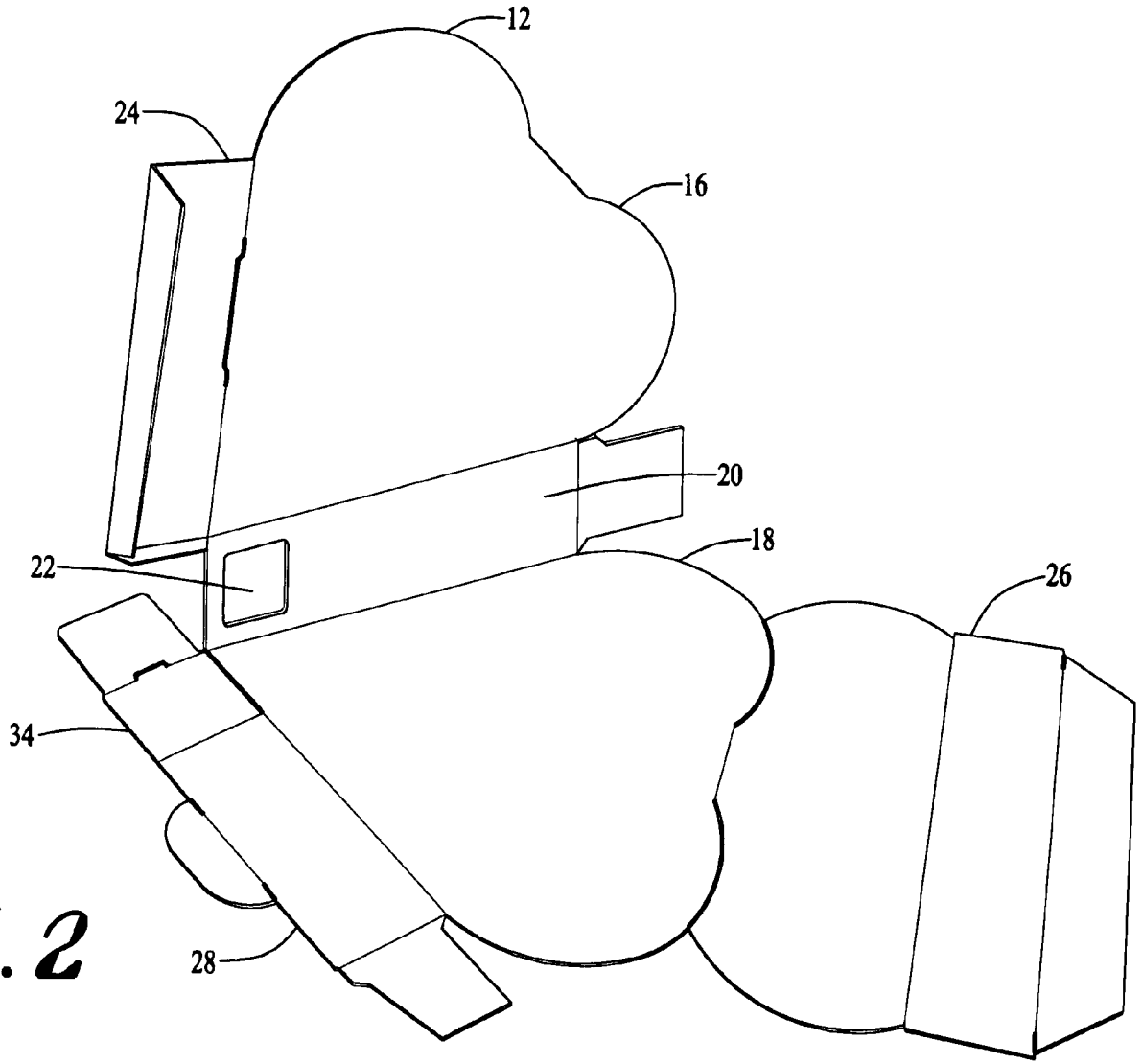
FIG. 2 is a perspective view of the first steps in folding the blank stock of the first embodiment into a heart-shaped box.
Figure 3:
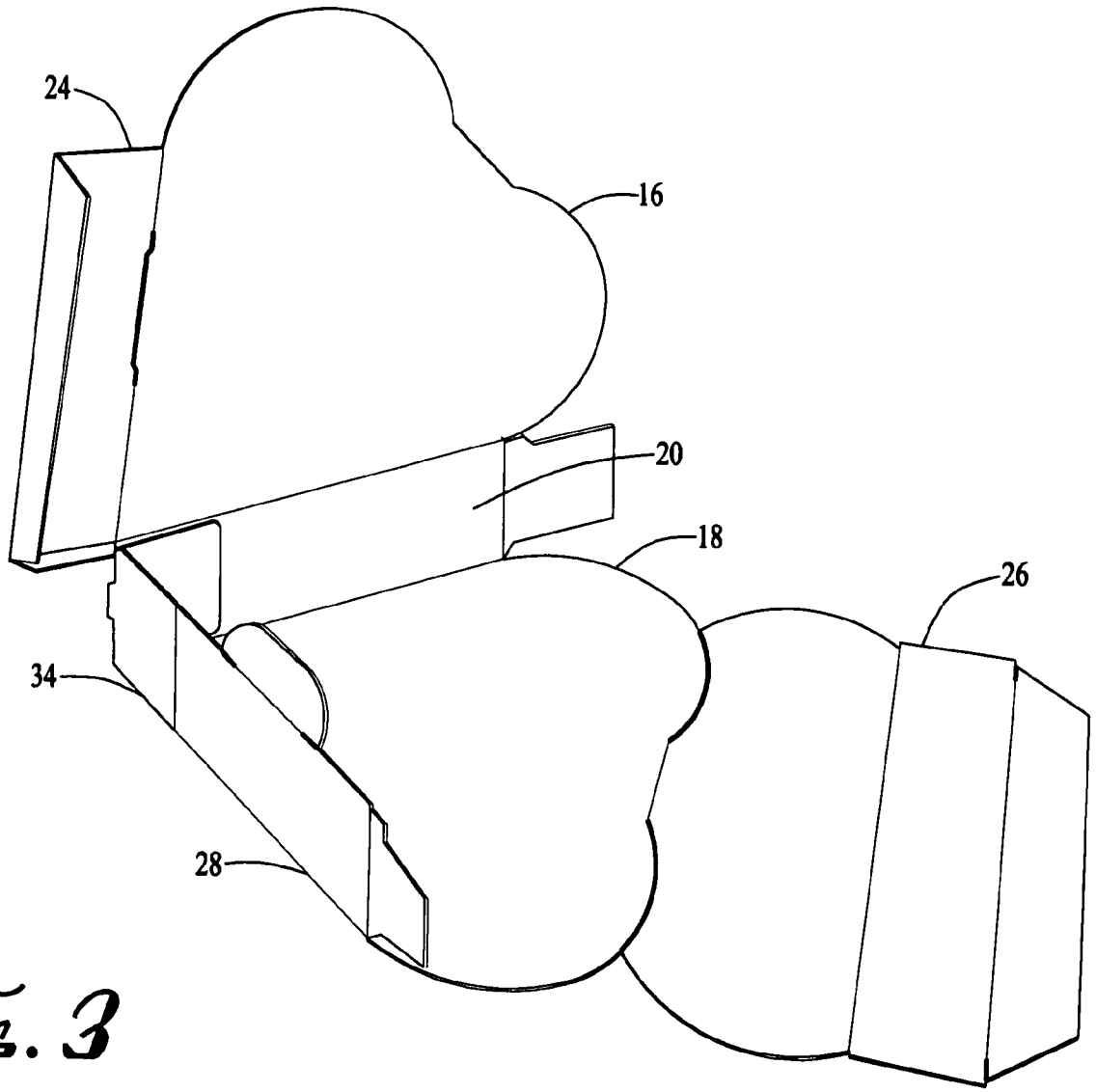
FIG. 3 is a perspective view of the second steps in folding the blank stock into a heart-shaped box.
Figure 4:
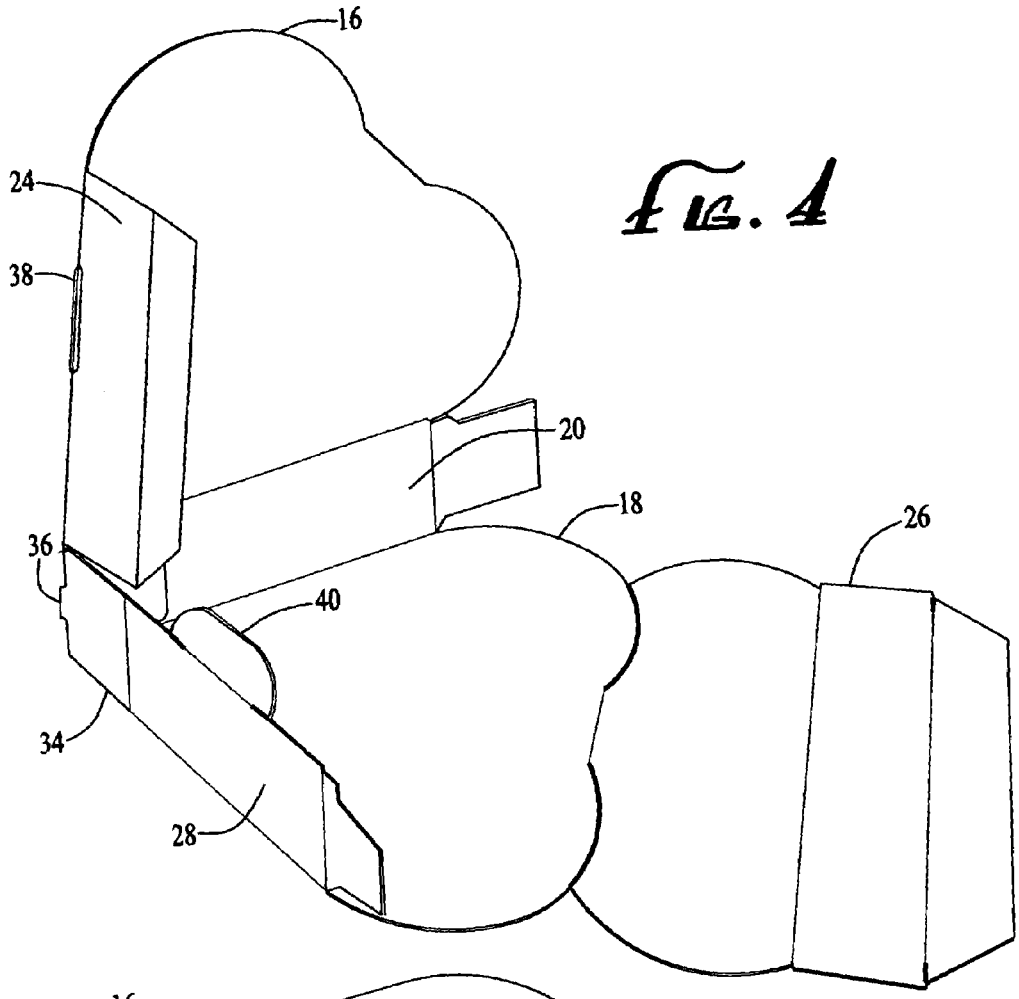
FIG. 4 is a perspective view of the third steps in folding the box.
Figure 6:
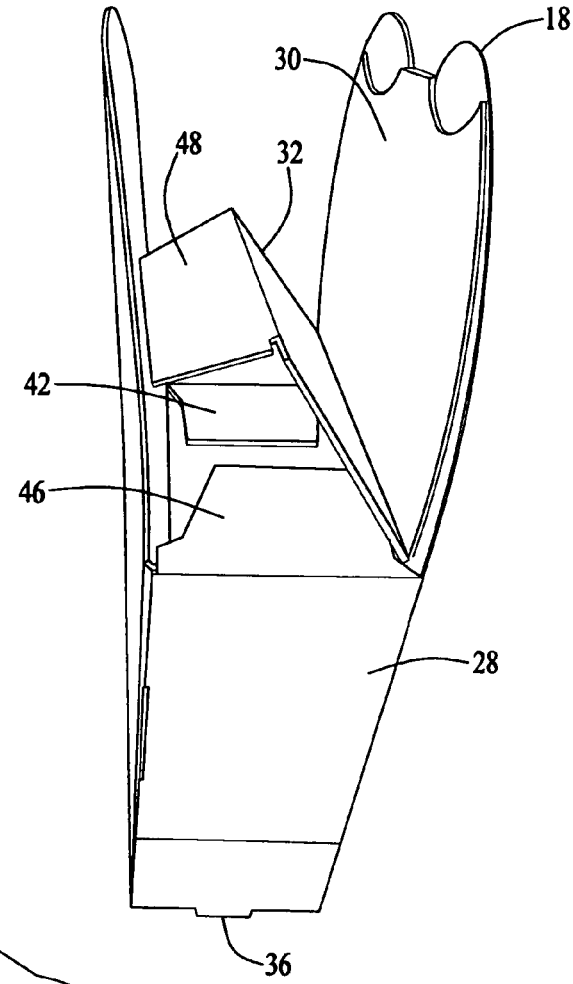
FIG. 6 is a perspective view of the fifth steps in folding the box.
Figure 7:
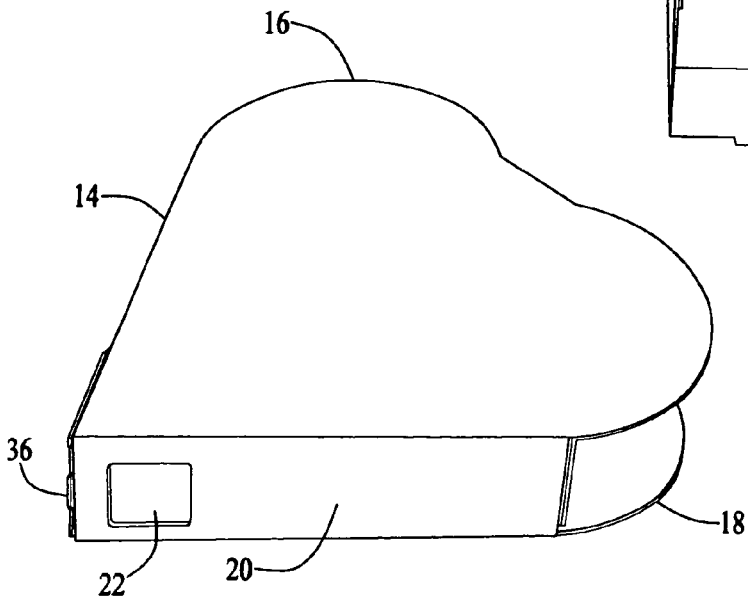
FIG. 7 is a perspective view of the fully-assembled heart-shaped box.

FIGS. 2-9 show the assembly of the package 10 of the first preferred embodiment. While folding of the box 10 is shown in a particular way and order of steps, there may be other ways and orderings of steps to reach the same end result. The blank 12 is folded between the second major side 18 and the first minor side 20 (as shown in FIG. 2). Then the slide member 34 and actuation panel 28 are folded towards the second major side 18 (FIG. 3). Next the second minor side 24 is folded towards the first major side 16 (FIG. 4). Then the first major side 16 and the second minor side 24 are folded towards the second major side 18, and the flap 40 placed inside the cut 38 (FIG. 5). Next the top portion 26 is folded (FIG. 6). The fully assembled box is shown in FIG. 7. Note that despite the outward appearance of the box being heart-shaped, in actuality the box is a three-sided, triangular shape.

Figure 8:
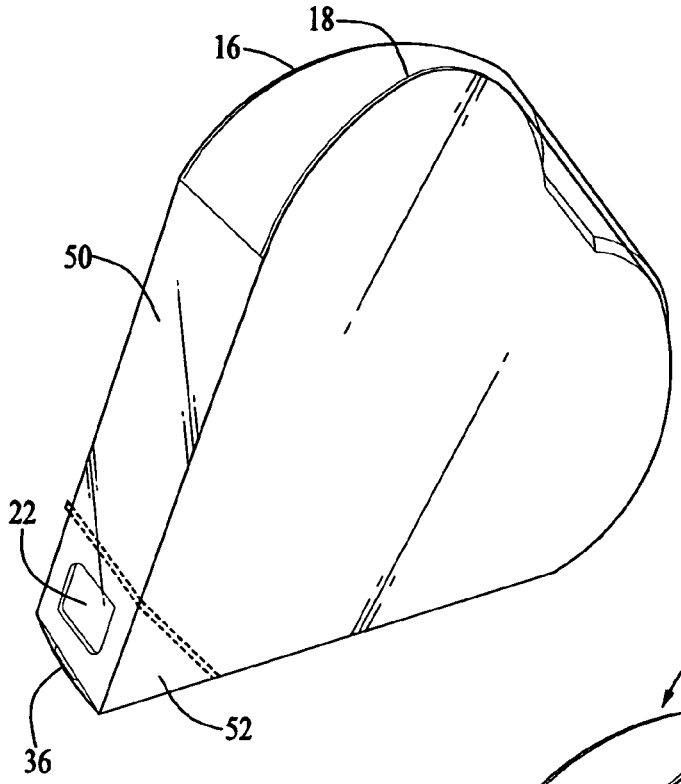
FIG. 8 is a perspective view of the box with the addition of cellophane wrapping.

FIG. 8 shows addition of a red-tinted cellophane wrapping 50 having a tear-away portion 52. The wrapping 50 need not be color-tinted cellophane but could be any type of decorative wrapping paper or the like. Once the tear-away portion 52 is removed, the slide member 34 is accessible to open the opening 22 and dispense the contents. At the same time, the decorative wrapping 50 tends to stay in place around the remainder of the box keeping the package 10 looking attractive. Note the wrapping 50 also pushes together the top portions of the heart-shaped major sides 12, 16 thereby hiding the top portion 26 of the box which adds to the attractiveness of the package 10.

Figure 10:
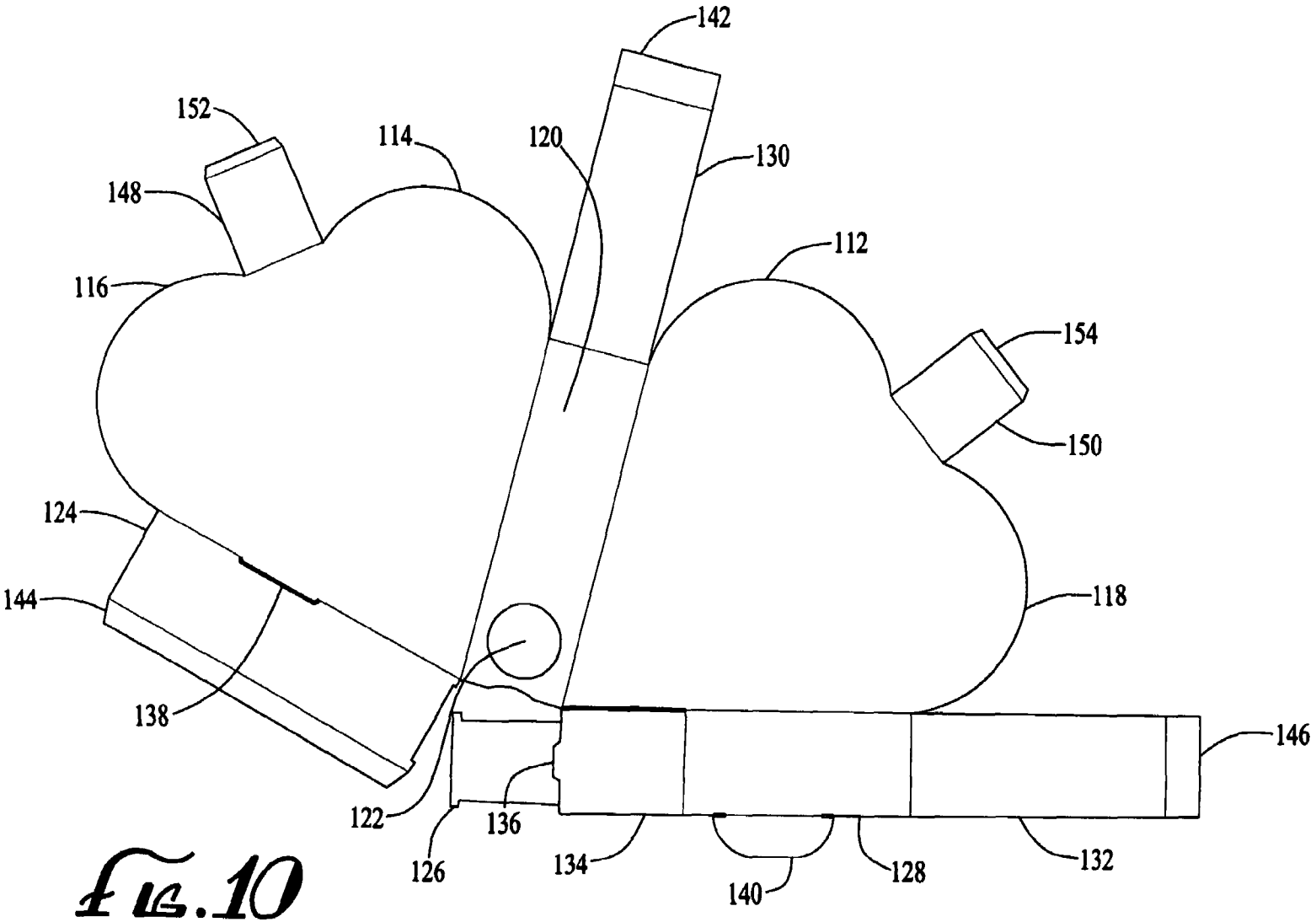
FIG. 10 is a flat pattern view of the blank stock from which the second preferred embodiment is made.

FIGS. 10-16 show a second-preferred embodiment package 110. FIG. 10 shows a blank 112 including a box portion 114 consisting of a first major side 116, a first minor side (with a circular opening 122) and a second major side 118. Attached to the first major side 116 is a second minor side 124, and attached to the second major side 118 is an actuation panel 128. Attached to the actuation panel 128 is a slide member 134 having a small cut 136 and a stop 126 at the end. Attached to the other end of the actuation panel 128 is a second top panel 132, and attached to the first minor side is a first top panel 130. Finally, attached to the first and second major sides 116, 188 at the center and top are first and second top tabs 148, 150, respectively. The larger cut 138 between the first major side 116 and second minor side 124 accommodates the flap 140, and there are other flaps including minor side 124 flap 144, top 130, 132 flaps 142, 146, and the tab 148, 150 flaps 152, 154.

Figure 11:
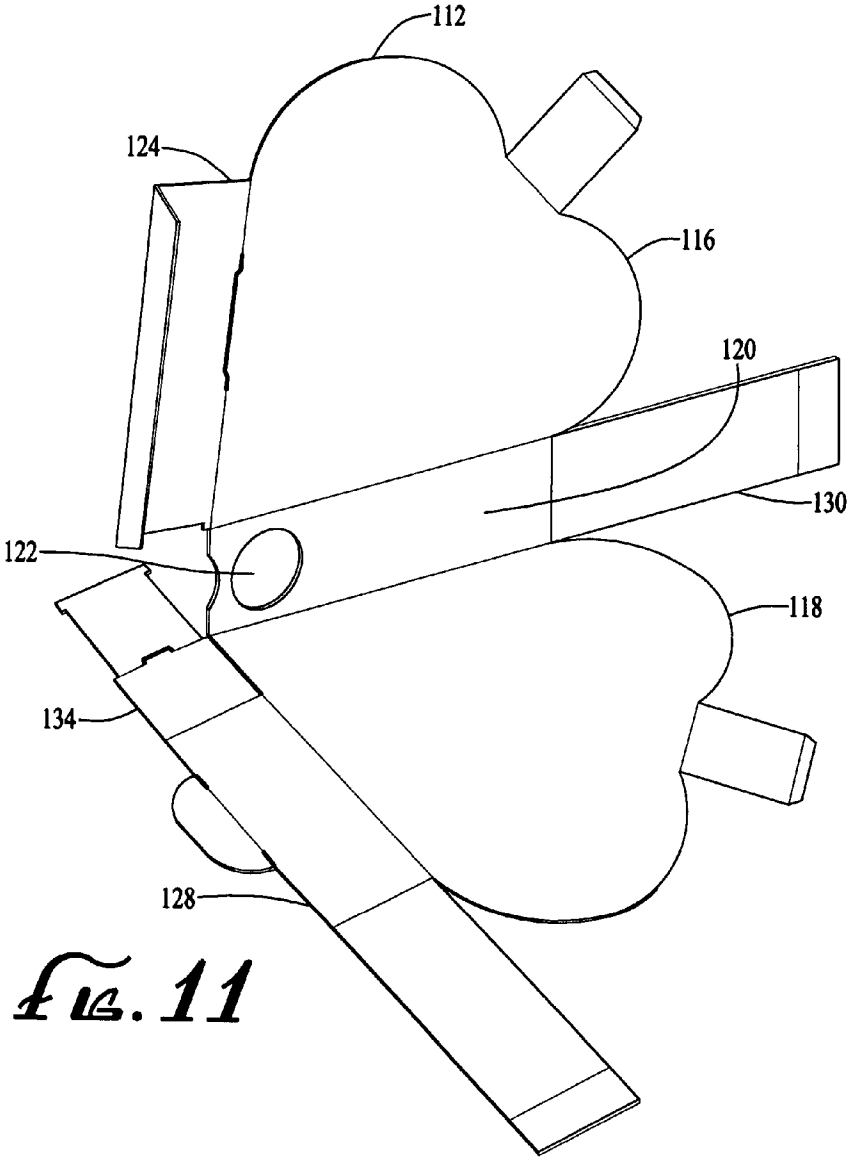
FIG. 11 is a perspective view of the first steps in folding the blank stock of the second embodiment into a heart-shaped box.
Figure 12:
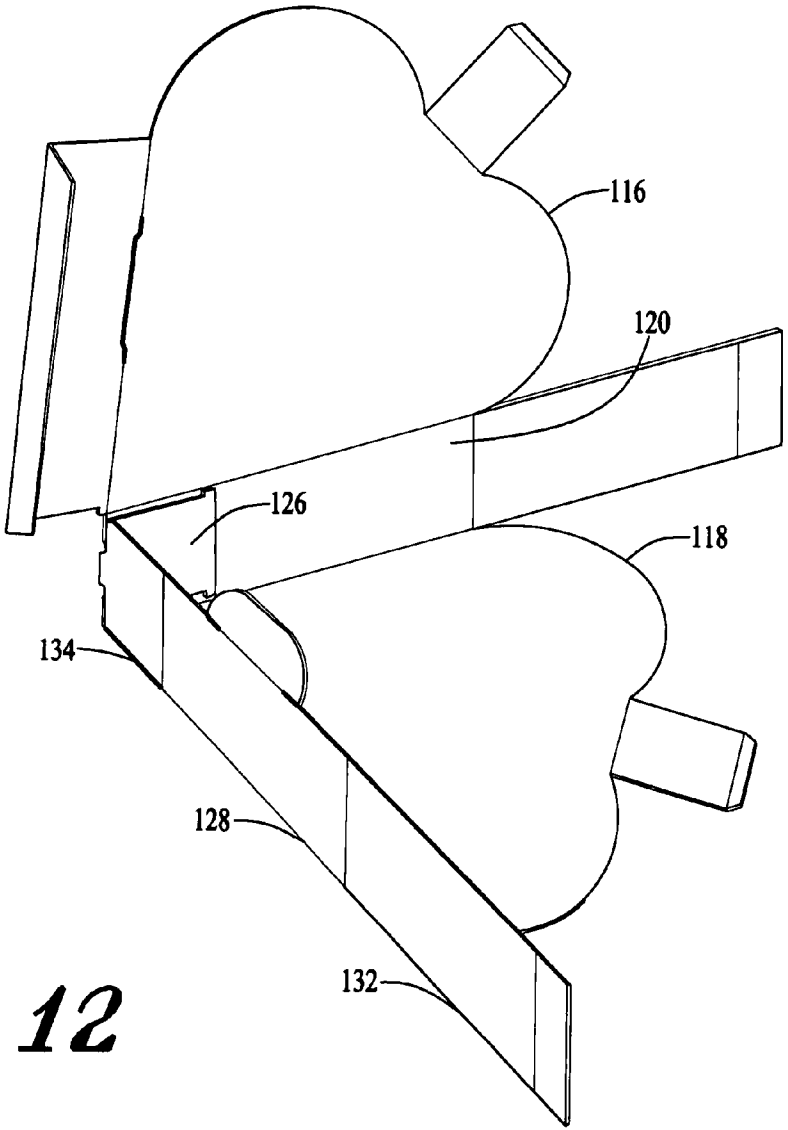
FIG. 12 is a perspective view of the second steps in folding the box.
Figures 13, 14:
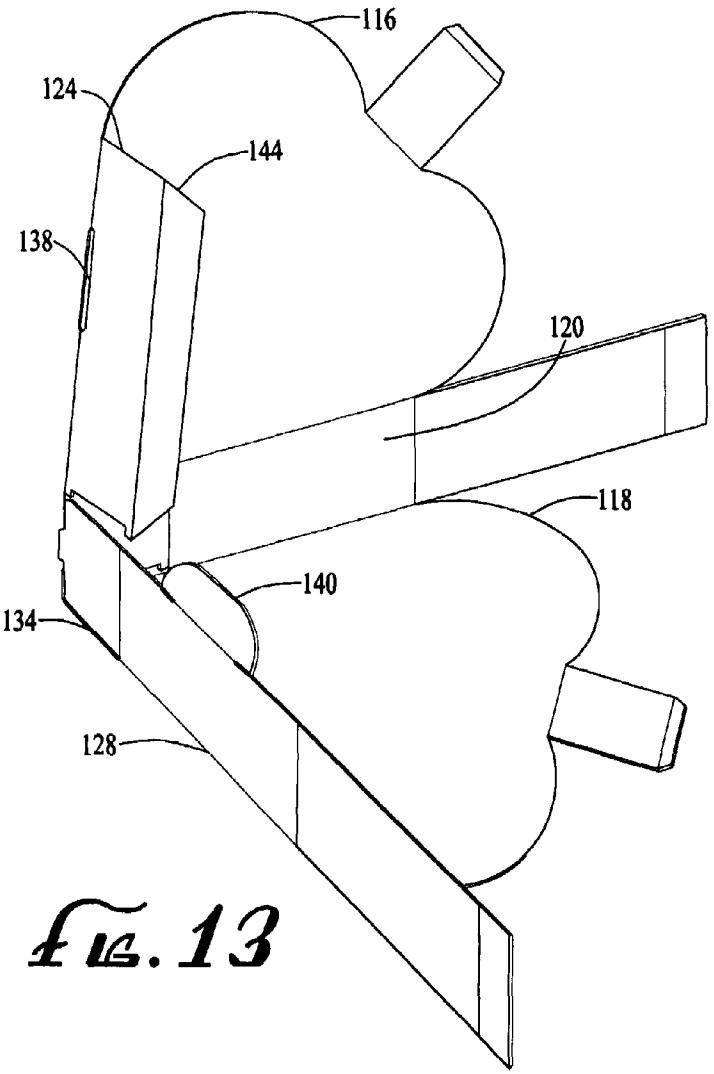
FIG. 13 is a perspective view of the third steps in folding the box.
FIG. 14 is a perspective view of the fourth steps in folding the box.
Figure 15:
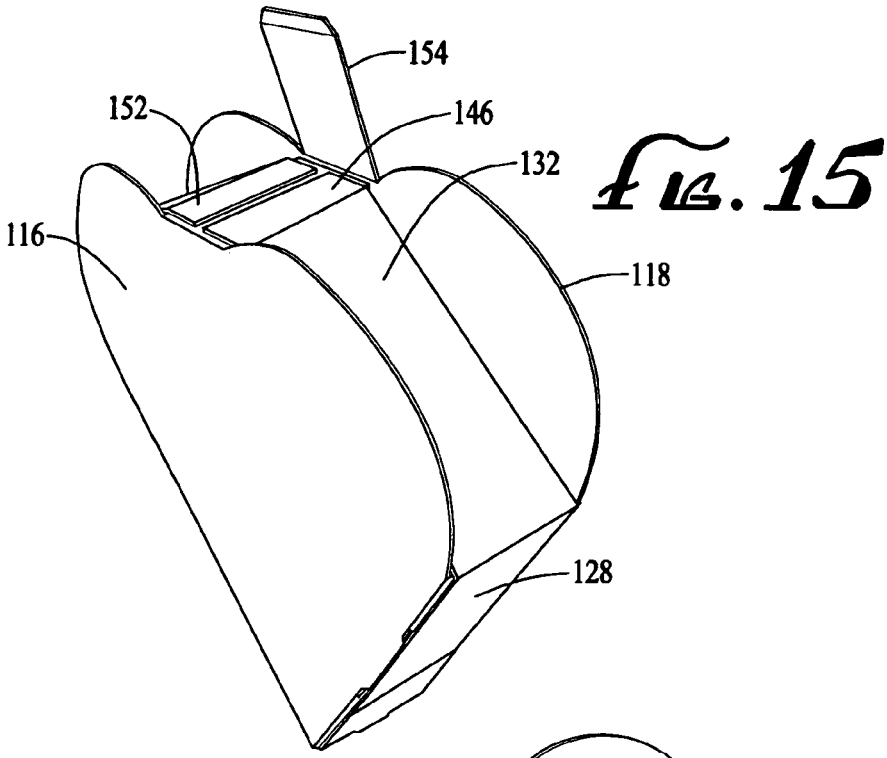
FIG. 15 is a perspective view of the fifth steps in folding the box.
Figure 16:
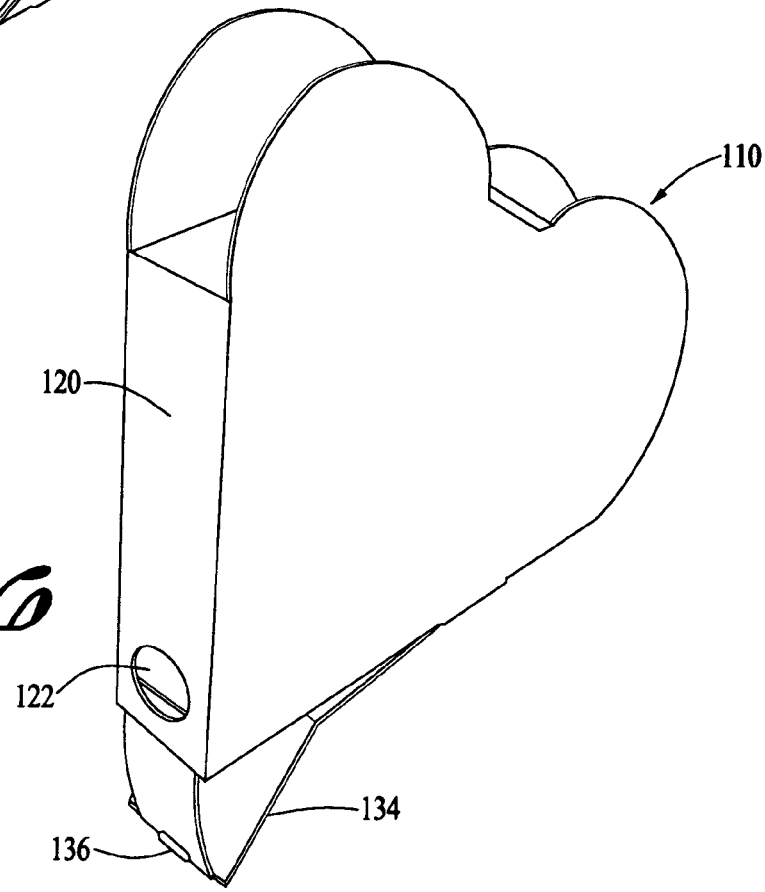
FIG. 16 is a perspective view of the fully-assembled box with the slider opening.

FIGS. 11-16 show assembly of the box 110 of the second-preferred embodiment. First the first major side 116, the first and second minor sides 120, 124 and the first top panel 130 are folded towards the second major side 118 (FIG. 11). Secondly the actuation panel 128, slide member 134 and second top panel 132 are folded towards the second major side 118 (FIG. 12). Thirdly the second major side is folded towards the first major side 116 (FIG. 13). Fourthly the actuation panel 128 flap 140 is inserted into the larger cut 138 (FIG. 14). Finally, the first tab 148 is folded down, and first and second top panels 130, 132 folded down over it, and the second tab 150 folded down over them (FIG. 15). A small dab of glue may be applied to secure the tab 154 to the flaps 146, 152. FIG. 16 shows the fully assembled box 110 and operation of the slide member 134 for dispensing through the opening 122. The small cut 136 helps make easy the moving of that edge of the slide member 134 away from the first minor side 120 of the box 110.

While particular forms of the invention have been illustrated and described, it will also be apparent to those skilled in the art that various modifications can be made without departing from the spirit and scope of the invention. Accordingly, it is not intended that the invention be limited except by the appended claims.

What is claimed is:

1. A package for dispensing pourable solid product comprising:

a box having a pair of substantially heart-shaped sides and a top and bottom portion;

a product dispensing opening in the bottom portion of the box;

a moveable slide for selectively opening and closing the product dispensing opening; and, said moveable slide is hingedly connected to an actuation panel extending down a side of the box.

2. The package of claim 1 further comprising a wrapping applied to the box with a tear-away portion covering the product dispensing opening and slide.

3. The package of claim 2 wherein portions of the heart-shaped sides are squeezed together by the wrapping applied to the box.

4. The package of claim 1 wherein the box has three generally straight sides despite the package having an outward appearance of being heart-shaped.

5. The package of claim 1 wherein the top of the box is formed by two top sides combined with the other minor sides defining a generally diamond shaped box despite the package having an outward appearance of being heart shaped.

6. The package of claim 1 wherein the box is formed from a single blank.

7. A package for dispensing pourable solid product comprising:

a box having a pair of substantially heart-shaped sides and a top and bottom portion;

a product dispensing opening in the bottom portion of the box;

a moveable slide for selectively opening and closing the product dispensing opening; and, a wrapping applied to the box with a tear-away portion covering the product dispensing opening and slide.

8. The package of claim 7 wherein said moveable slide is hingedly connected to an actuation panel extending down a side of the box.

9. The package of claim 7 wherein portions of the heart-shaped sides are squeezed together by the wrapping applied to the box.

10. The package of claim 7 wherein the box is generally triangular shaped despite the package having an outward appearance of being heart-shaped.

11. The package of claim 7 wherein the box is formed from a single blank.

12. A blank for forming a dispensing box comprising:

a main box portion having two major sides of a generally heart-shaped configuration and a minor side therebetween of a generally rectangular configuration and having an opening therein;

a top of a generally rectangular configuration foldably coupled to the main box portion;

a second minor side of a generally rectangular configuration foldably coupled to one of the major sides and an actuation panel of a generally rectangular configuration foldably coupled to the other of the major sides; and a slide member foldably coupled to the actuation panel.

13. The blank of claim 12 further comprising a stop at the end of the slide member.

14. The blank of claim 12 wherein the top is foldably coupled to one of the major sides.

15. The blank of claim 12 wherein the top is two sides each foldably coupled to one of the minor sides.

* * * * *